US005558218A

United States Patent [19]

James et al.

[11] Patent Number: 5,558,218

[45] Date of Patent: Sep. 24, 1996

[54] SHIPPING CONTAINER FOR LARGE CYLINDRICAL SLEEVES

[75] Inventors: William A. James, Long Branch; Stephen H. Breitkopf, North Brunswick; Robert G. Provell, Spotswood, all of N.J.; Ralph A. Moody, III, Fuquay-Varina, N.C.

[73] Assignee: McNeil-PPC, Inc., Skillman, N.J.

[21] Appl. No.: 284,869

[22] Filed: Aug. 2, 1994

[51] Int. Cl.[6] ..... B65G 65/30; B65D 85/02; B65B 19/00

[52] U.S. Cl. ..... 206/303; 53/473; 206/446; 414/786

[58] Field of Search ..... 28/105; 53/409, 53/472, 473; 206/303, 446, 493; 414/289, 298, 304, 786, 910

[56] References Cited

U.S. PATENT DOCUMENTS

| | | | |
|---|---|---|---|
| 2,423,986 | 7/1947 | Lathrope | 206/446 |
| 4,615,501 | 10/1986 | Pezold | 206/493 |
| 4,938,358 | 7/1990 | Johansen | 206/303 |
| 5,267,648 | 12/1993 | Baker | 206/446 |

FOREIGN PATENT DOCUMENTS

| | | | |
|---|---|---|---|
| 1661067 | 7/1991 | U.S.S.R. | 206/446 |

*Primary Examiner*—Jimmy G. Foster

[57] ABSTRACT

Shipping container for transporting a fragile cylindrical sleeve is constructed to facilitate mounting and demounting of the sleeve without any damage thereto. The container is designed to align the sleeve with a mandrel in a surfacing machine or a drum of a nonwoven fabric producing machine, which is useful when a cylindrical sleeve is being transferred from the shipping container onto the mandrel or drum, or vice versa. The container is useful in transporting a blank cylindrical sleeve from its production facility to a surfacing facility, aligning and mounting the blank sleeve on a mandrel in a surfacing machine, removing the machined sleeve from the surfacing machine, transporting the machined sleeve to a nonwoven fabric production facility, and mounting and aligning the machined sleeve on a nonwoven fabric producing machine. The container includes an elongated outer housing having front and rear ends. Two doors are positioned at the front end of the outer housing to provide access to the interior of the housing to place a cylindrical sleeve therein or to remove a cylindrical sleeve therefrom. A support tube, on which the cylindrical sleeve is supported in the container, is mounted within the container by a cantilever mounting at the rear end of the outer housing.

41 Claims, 12 Drawing Sheets

SHIPPING CONTAINER FOR LARGE CYLINDRICAL SLEEVES

BACKGROUND OF THE INVENTION

1. Field of the Invention

The present invention relates generally to a shipping container for large cylindrical sleeves, and also to a method for handling a cylindrical sleeve in the fabrication of nonwoven fabrics. More particularly, the subject invention pertains to a shipping container for large cylindrical sleeves which are used, among other purposes, in the production of nonwoven fabrics. In this area of technology, the present invention is useful in shipping a blank cylindrical backing sleeve from its production facility to a surfacing machine, mounting and aligning the blank cylindrical backing sleeve on a mandrel in the surfacing machine, after surfacing, removing the cylindrical backing sleeve from the mandrel in the surfacing machine, transporting the machined cylindrical backing sleeve from the surfacing machine to a nonwoven fabric production facility, and mounting and aligning the machined cylindrical backing sleeve on a nonwoven fabric producing machine.

2. Discussion of the Prior Art

It is known in the prior art to produce relatively large machined cylindrical backing sleeves which are used, among other purposes, in the production of nonwoven fabrics. In general, nonwoven fabrics can be produced by directing controlled water flows against a layer of fibers supported on a cylindrical backing sleeve having a predetermined topography with patterns of pyramids and hole openings formed thereon, as disclosed for instance in Drelich et al. U.S. Pat. No. 5,098,764. The cylindrical backing sleeve disclosed in the '764 patent has a three-dimensional surface which includes a plurality of pyramids disposed in a pattern thereover. The sides of the pyramids are at an angle of greater than 55° to the surface of the cylindrical backing sleeve, and an angle of 75° produces excellent fabrics. The cylindrical backing sleeve also defines a plurality of hole openings therein disposed in the areas where the sides of the pyramids meet the backing sleeve. This prior art approach to producing nonwoven fabrics is disclosed in detail in Drelich et al. U.S. Pat. No. 5,098,764.

The length of the cylindrical backing sleeve as described hereinabove can vary in different embodiments from several feet to thirteen or fourteen feet or more. The pyramids and holes defined on the surface of the cylindrical backing sleeve are quite small, the number of pyramids is typically 100 to 2500 per square inch, and the number of holes may typically be 400 to 5000 per square inch, with the diameter of each hole typically being between 0.010 and 0.035 inches. As disclosed in U.S. Pat. No. 5,098,764, a hole is typically positioned at each corner of each pyramid and at the center of each side of each pyramid.

Such a cylindrical backing sleeve having a surface topography with such fine details can be produced on a surfacing machine in which a cylindrical sleeve blank, typically formed of a suitable plastic material, is mounted for rotation on a mandrel in the surfacing machine. The cylindrical sleeve blank is rotated on the mandrel past a surfacing head operating against the cylindrical sleeve blank. During a surfacing operation, the surfacing head is slowly translated along the length of the cylindrical sleeve blank, and material is selectively removed from the surface of the cylindrical sleeve blank to form a pattern of the type described in U.S. Pat. No. 5,098,764.

Accordingly, with the arrangement as described hereinabove, the surface of a cylindrical backing sleeve is selectively machined to produce a desired very fine pattern of pyramids and holes thereon. The cylindrical backing sleeve might typically have a diameter of 3–6 feet and a length of 4 to 14 feet, and the total surfacing process for a cylindrical sleeve that size might typically take one to three weeks, operating 24 hours a day.

The resultant machined cylindrical backing sleeve must typically be removed from the surfacing machine, and shipped from the surfacing facility to a nonwoven fabric production facility where the cylindrical backing sleeve is used to produce nonwoven fabric in a manner as disclosed in U.S. Pat. No. 5,098,764. Moreover, the surfaced cylindrical backing sleeve defines a very fine pattern of pyramids and holes on its surface which must not be damaged during the transportation process.

The present invention concerns a shipping container which is specifically designed to be useful in shipping a blank cylindrical backing sleeve from its production facility to a surfacing facility, mounting and aligning the blank cylindrical backing sleeve on a mandrel in a surfacing machine, after machining, removing the cylindrical backing sleeve from the mandrel in the surfacing machine, transporting the machined cylindrical backing sleeve from the surfacing facility to a nonwoven fabric production facility, and mounting and aligning the machined cylindrical backing sleeve on a nonwoven fabric producing machine.

At the conclusion of a nonwoven fabric production the shipping container is used to remove the sleeve from the nonwoven fabric producing machine and for storage of the sleeve.

SUMMARY OF THE INVENTION

Accordingly, it is a primary object of the present invention to provide a shipping container for transporting large cylindrical sleeves, and also to a method for handling a cylindrical sleeve in the above operations and for storage of the sleeves.

A further object of the subject invention is the provision of a shipping container which is useful in transporting a large relatively fragile cylindrical sleeve, which is constructed in a manner to facilitate easy mounting and demounting of the cylindrical sleeve without any damage thereto. Moreover, the shipping container is designed to readily align the cylindrical sleeve with a mandrel of a surfacing machine or a nonwoven fabric producing machine, which is helpful when a cylindrical sleeve is being transferred, e.g., from the shipping container onto a mandrel of a surfacing machine or a drum of a nonwoven fabric producing machine.

The shipping container is useful in transporting a blank cylindrical backing sleeve from its production facility to a surfacing facility, aligning and mounting the blank cylindrical backing sleeve on the mandrel in the surfacing machine, after machining, removing the cylindrical backing sleeve from the mandrel in the surfacing machine, transporting the machined cylindrical backing sleeve from the surfacing facility to a nonwoven fabric production facility, and mounting and aligning the machined cylindrical backing sleeve on a drum of a nonwoven fabric producing machine.

In accordance with the teachings herein, the present invention provides a shipping container, for transporting a large cylindrical sleeve, which includes an elongated outer housing having first and second spaced opposite ends. At least one door is positioned at the first end of the outer housing to provide access to the interior of the housing to place a cylindrical sleeve therein or to remove a cylindrical backing sleeve therefrom. A structural support tube, on which the large cylindrical sleeve is supported in the shipping container, is mounted within the shipping container by a cantilever mounting at the second end of the outer housing. The support tube extends interiorly, and substantially to the first end, of the outer housing.

In greater detail, the support tube is cantilever mounted at the second end of the outer housing by a bulkhead ring which is mounted to a bulkhead frame adjacent to the second end of the shipping container. The support tube is also secured to an end cover wall at the second end of the shipping container. The door at the first end of the shipping container has a support ring attached thereto such that when the door is closed, the support ring supports the end of the support tube opposite to the cantilever mounting. The elongated outer housing comprises an elongated rectangular shaped box, and preferably includes first and second doors forming the first end of the elongated rectangular box. Each of the first and second doors is hinged respectively to first and second sides of the elongated rectangular box, and each of the first and second doors forms one half of the first end of the elongated rectangular box. In greater detail, each of the first and second doors includes one half of an end closure wall at the first end of the shipping container. Each half end closure wall includes one half of a split support ring which, when the first and second doors are fully closed, clamps around and supports the projecting end of the support tube at the first end of the shipping container.

The support tube includes a cylindrical surface and a plurality of alignment rollers extending radially inwardly from the inner cylindrical surface of the support tube at a first end thereof. The alignment rollers form a first alignment to align a first end of the cylindrical sleeve supported within the shipping container with a mandrel in a surfacing machine, or a drum of a nonwoven fabric forming machine, which is initially positioned and aligned between the radially inwardly extending alignment rollers.

An alignment target, such as a cross-hair target, is also provided at the second end of the shipping container for an alignment laser beam produced by a visible laser positioned within the mandrel in the surfacing machine or the drum of the nonwoven fabric production machine to more precisely align the second end of a cylindrical backing sleeve supported within the shipping container with the mandrel or the drum. In greater detail, the alignment target is formed on a target panel secured to the end of the support tube at the second end of the shipping container.

The first alignment with the radially inwardly extending alignment rollers aligns the first end of the support tube, and a cylindrical sleeve supported thereby, with a mandrel in a surfacing machine or a drum of a nonwoven fabric forming machine. The second alignment with the laser alignment target aligns the second end of the support tube and the cylindrical sleeve with the mandrel in the surfacing machine or the drum of the nonwoven fabric forming machine. The combination of the first and second alignments ensures that the support tube and a cylindrical sleeve supported thereby are aligned and coaxial with the mandrel or the drum.

The shipping container is provided with a variety of features to enable it to be handled and moved by a variety of freight handling equipment. The shipping container includes forklift truck brackets centrally positioned in a bottom surface of the shipping container, lifting eye brackets extending from a top surface of the shipping container, a carpet pole lifting tube extending longitudinally along the length of the shipping container and having a carpet pole opening in the second end wall of the shipping container, and a pair of spaced support tubes extending longitudinally along the length of the shipping container from spaced support tube openings near the bottom of the second end wall of the shipping container, for a special type of forklift truck attachment device.

The shipping container is preferably constructed with a plywood exterior housing having front, back, upper, lower and side walls formed of plywood. A plurality of bulkhead frames are positioned along the length of the elongated shipping container.

The present invention also provides a method of handling a cylindrical backing sleeve. A three-dimensional topographical pattern is formed on a blank cylindrical backing sleeve while the sleeve is held on a mandrel in a surfacing machine. The cylindrical backing sleeve is transferred into a shipping container by placing the cylindrical backing sleeve on a support tube which is mounted within the shipping container by a cantilever mounting at one end of the shipping container. During the transfer, the cylindrical backing sleeve is aligned with the shipping container by using a first alignment using alignment guides, such as alignment rollers, on the support tube which are aligned relative to a mandrel or drum. A second alignment uses a laser target on the shipping container and a laser mounted on the mandrel or drum. The cylindrical backing sleeve is then transferred from the shipping container to a drum of a fabric forming machine while aligning the cylindrical backing sleeve with the drum by using the first alignment guides and the second alignment laser target on the shipping container and a laser on the drum. The first and second alignments align, respectively, the first and second ends of the support tube, and a cylindrical sleeve supported thereby, with a mandrel in a surfacing machine or a drum of a nonwoven fabric forming machine. The combination of the first and second alignments ensures that the support tube and the cylindrical sleeve supported thereby are aligned and coaxial with the mandrel or the drum. The cylindrical backing sleeve is used to produce a nonwoven fabric by positioning a layer of fibrous material on the cylindrical backing sleeve and projecting fluid against the fibrous material and cylindrical backing sleeve to form the nonwoven fabric.

In greater detail, initially a blank cylindrical backing sleeve is mounted on a mandrel in a surfacing machine at a surfacing machine facility. The cylindrical backing sleeve is then machined, after which the machined cylindrical backing sleeve is removed from the mandrel in the surfacing machine. The machined cylindrical backing sleeve is then transported from the surfacing facility to a nonwoven fabric production facility by utilizing a shipping container pursuant to the present invention.

The same shipping container is also used to transport a blank cylindrical backing sleeve to the surfacing machine. The surfacing machine machines the surface of the cylindrical backing sleeve with a predetermined topography with, e.g., patterns of pyramids and hole openings formed thereon. A plurality of pyramids are disposed in a pattern thereover, and a plurality of hole openings are formed therein disposed in the areas where the sides of the pyramids meet the backing sleeve. During the surfacing operation, a cylindrical sleeve blank is mounted for rotation on the mandrel in the surfacing machine. The cylindrical sleeve blank is rotated on the mandrelpast a surfacing head working against the cylindrical sleeve blank, and the surfacing head is slowly translated along the length of the cylindrical sleeve blank. Material is selectively removed from the surface of the cylindrical sleeve to form a pattern of the type described in U.S. Pat. No. 5,098,764.

Pursuant to the method of the present invention, a first end of the support tube includes a plurality of alignment rollers extending radially inwardly from its inner cylindrical surface. The alignment rollers are placed around an alignment cylinder extending from the mandrel in the surfacing machine or the drum of the fabric forming machine, which is initially positioned and aligned between the radially inwardly extending alignment rollers. The first alignment with the radially inwardly extending alignment rollers aligns a first end of the cylindrical sleeve with the mandrel or drum. A second alignment with a laser and laser alignment target aligns the second end of the cylindrical sleeve with the mandrel or drum. The combination of the first and second alignments ensures that the cylindrical sleeve is aligned and coaxial with the mandrel or the drum.

BRIEF DESCRIPTION OF THE DRAWINGS

The foregoing objects and advantages of the present invention for a shipping container for large cylindrical sleeves may be more readily understood by one skilled in the art with reference being had to the following detailed description of a preferred embodiment thereof, taken in conjunction with the accompanying drawings wherein like elements are designated by identical reference numerals throughout the several views, and in which.

DETAILED DESCRIPTION OF THE DRAWINGS

Figure 1:
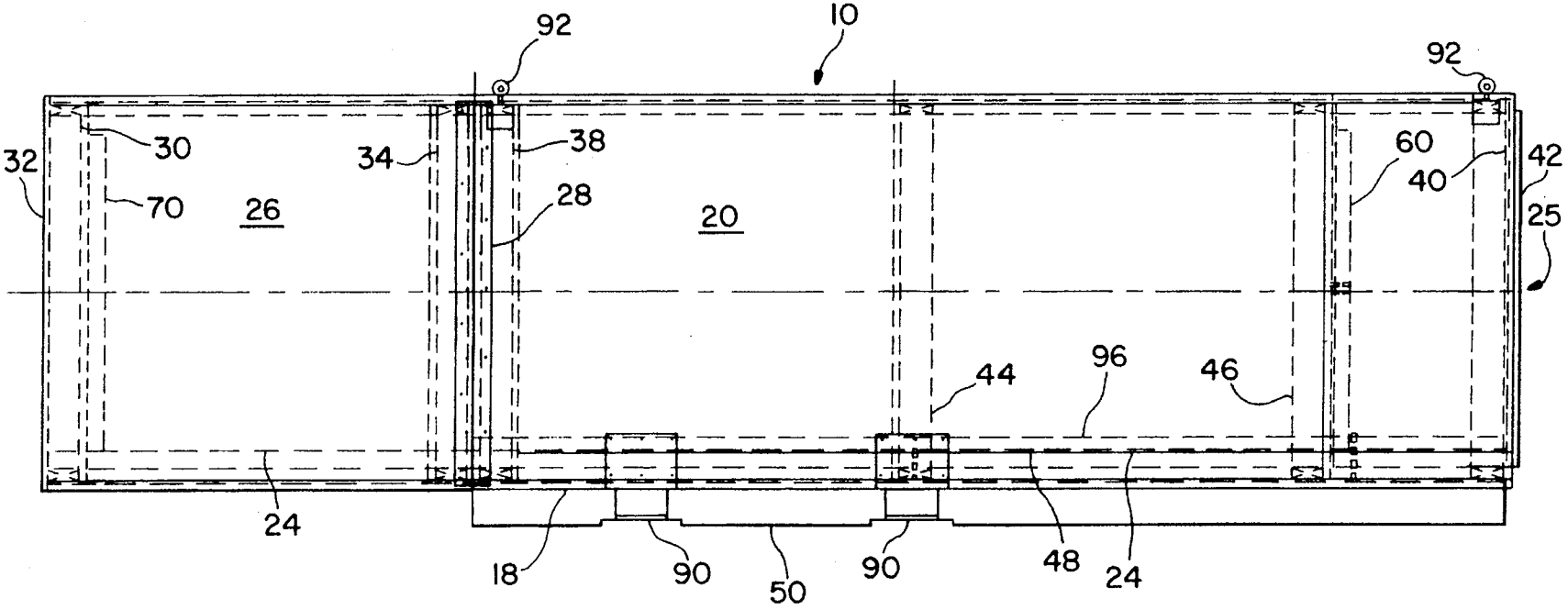
FIGS. 1 and 2 are respectively side elevational and top plan views of a shipping container for large cylindrical sleeves constructed pursuant to the teachings of the present invention.
Figure 2:
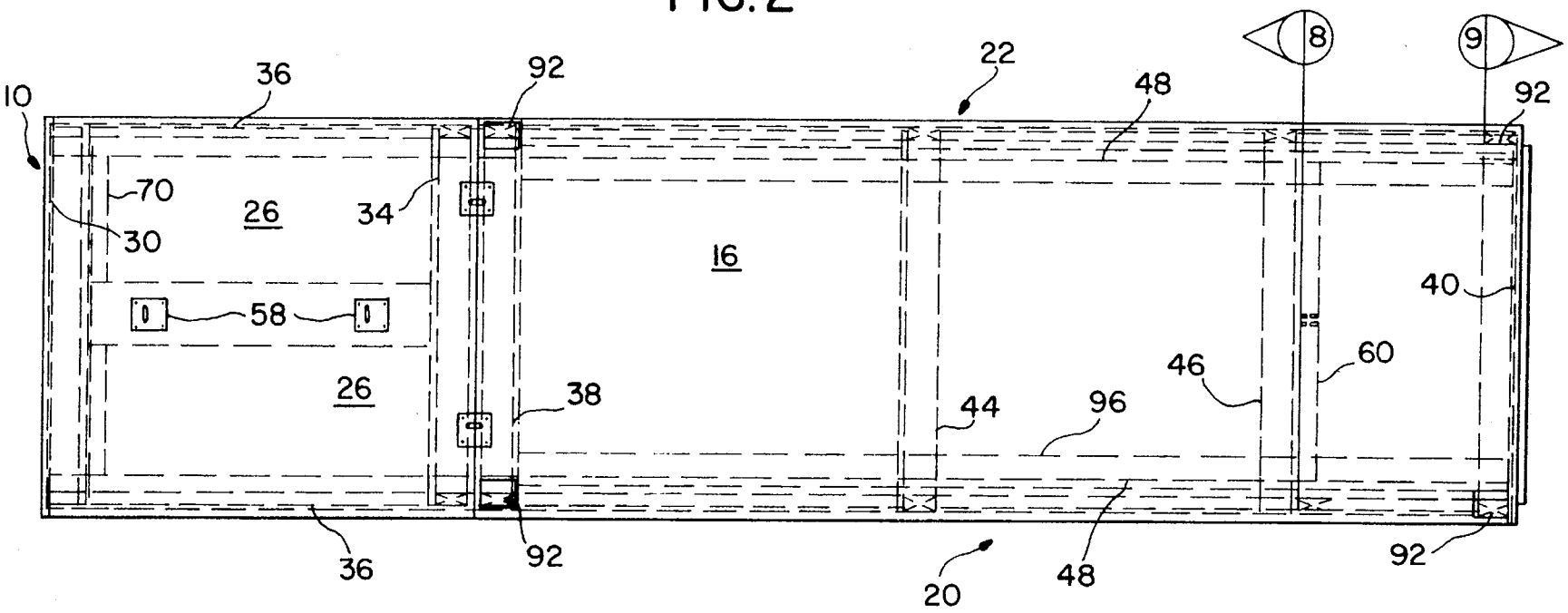
Figure 3:
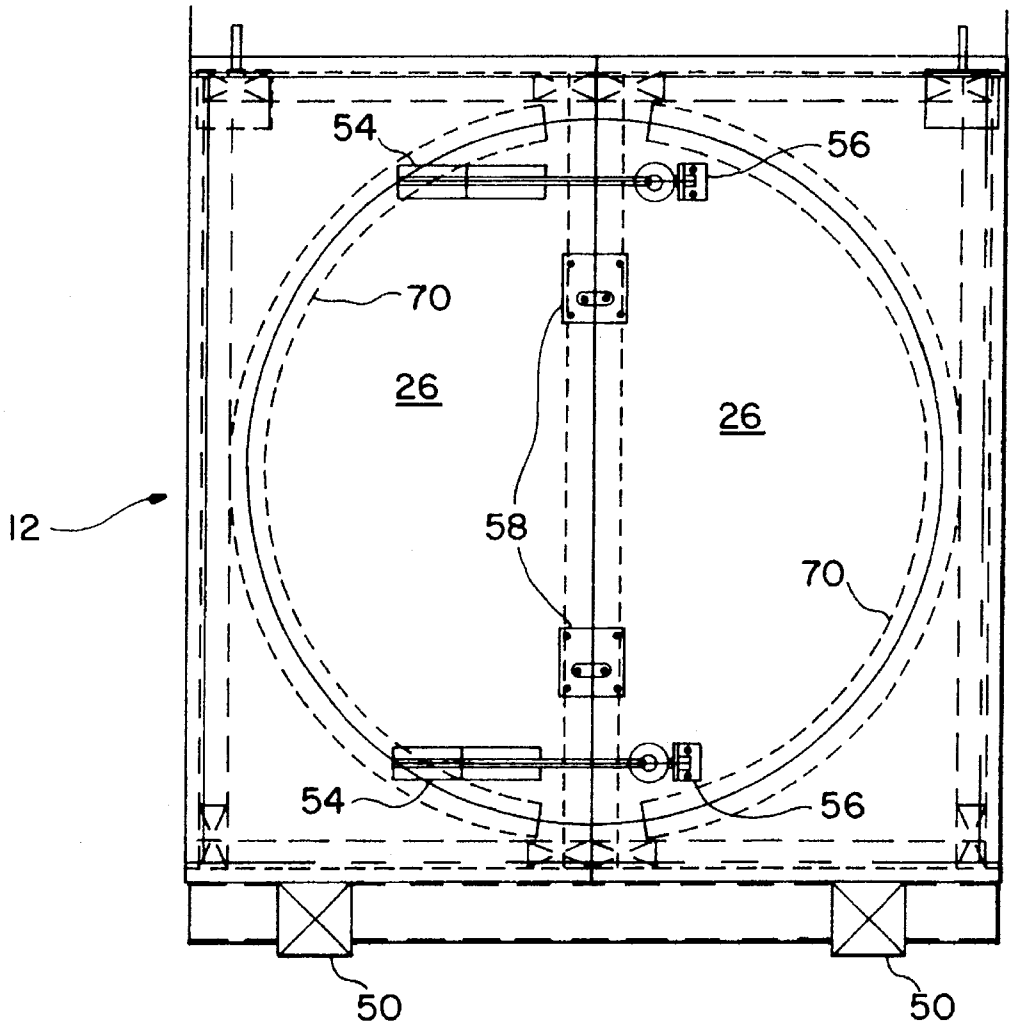
FIGS. 3 and 4 are respectively left front elevational and right rear elevational views of the shipping container for large cylindrical sleeves illustrated in FIGS. 1 and 2.

Referring to the drawings in detail, FIGS. 1, 2, 3 and 4 are respectively side elevational, top plan, left front elevational, and right rear elevational views of a shipping container 10 constructed pursuant to the teachings of the present invention, for transporting a large cylindrical sleeve. The shipping container 10 is preferably in the shape of an elongated rectangular box having front and rear surfaces 12, 14, upper and lower surfaces 16, 18, and side surfaces 20 and 22. The shipping container is preferably constructed of plywood, having the front, rear, upper, lower and side surfaces thereof formed of ¾" exterior grade plywood.

A support tube assembly 24 is provided in the shipping container 10, on which is mounted a large cylindrical sleeve being transported in the shipping container 10. The support tube assembly 24 is mounted within the shipping container by a cantilever mounting at the rear end 25 of the shipping container, as explained in further detail hereinbelow. The support tube assembly 24 extends interiorly of, and substantially to the front end, of the shipping container, at which one or more front doors 26 provide access to the interior of the shipping container.

The shipping container 10 preferably includes first and second doors 26 forming the front end of the elongated rectangular box. Each of the first and second doors 26 forms one half of the front end of the elongated rectangular box, and is hinged by a piano type hinge 28, respectively, to the first and second sides 20, 22 of the elongated rectangular box. The doors 26 provide access to the interior of the shipping container to place therein a cylindrical sleeve being transported or to remove therefrom a cylindrical sleeve. Although the illustrated preferred embodiment has two doors 26, alternative embodiments might include other door arrangements, such as a single front door which is hinged relative to the main body of the shipping container, or which is bolted onto the main body of the shipping container without a hinge.

In general, the length of the doors 26 in the preferred embodiment will depend upon the length of the cylindrical sleeve transported by the shipping container, and the arrangement of the surfacing machine in which the cylindrical sleeve is machined. As stated hereinabove, the cylindrical sleeve might typically have a diameter of 3 to 6 feet and a length varying from several feet to thirteen or fourteen feet or more. Accordingly, the dimensions of the shipping container will vary in dependence thereon.

The shipping container 10 is formed with a number of frame members, and each door includes a forward transverse frame 30 which supports thereon a front closure panel 32, a rearward transverse frame 34 at which the door is pivoted by the piano hinge 28 to the main body of the shipping container, and longitudinal frame members 36 extending along the length of each door.

The main body of the shipping container is also formed with a number of transverse frames, including a forward transverse frame 38 at which the door is pivoted by the piano hinge to the main body, a rearward transverse frame 40, to which a rear end closure surface 42 is secured, and intermediate bulkhead frames 44, 46. The main body of the shipping container also includes longitudinal frame members 48 extending along the length of the main body of the shipping container. The main body of the shipping container is supported on bottom beams 50 extending along the length thereof.

In the closed position of the doors 26, the two doors 26 are latched together by several latches to form a relatively rigid structure with the main body of the shipping container. The latches include on the front 12 of the container two adjustable draw latch fasteners 54 with hooked latching rods coupled to two draw latch brackets 56, as are commercially available from Southco Fasteners, 210 N. Brinton Lake Road, Concordville, Pa. 19331, and two additional dual lock latches and lock receptacles 58, as are commercially available from Simmons Fastener Co., 1750 N. Broadway, Albany, N.Y. 12201. The tops of the two doors 26 also include two or more additional dual lock latches and lock receptacles 58, as are commercially available from Simmons Fastener Co.

Figure 4:
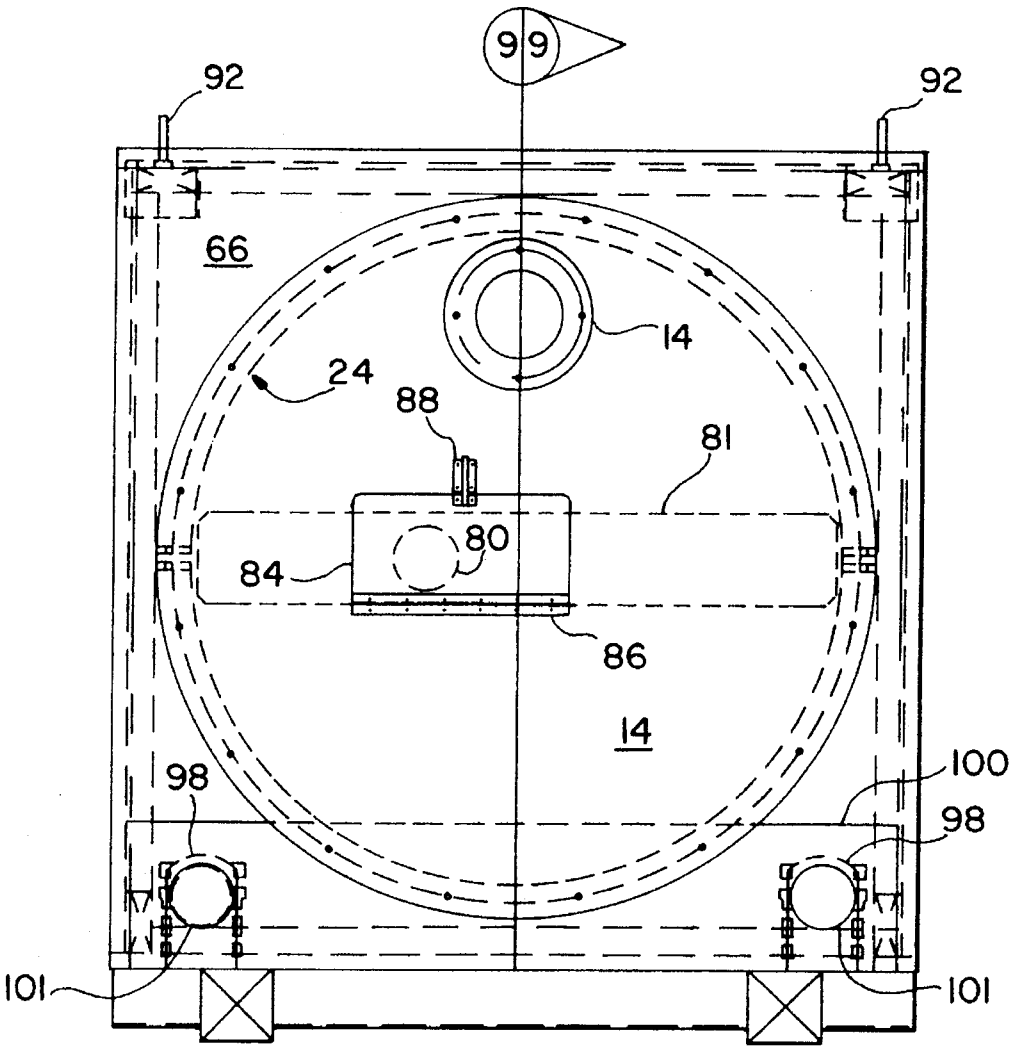
Figure 5:
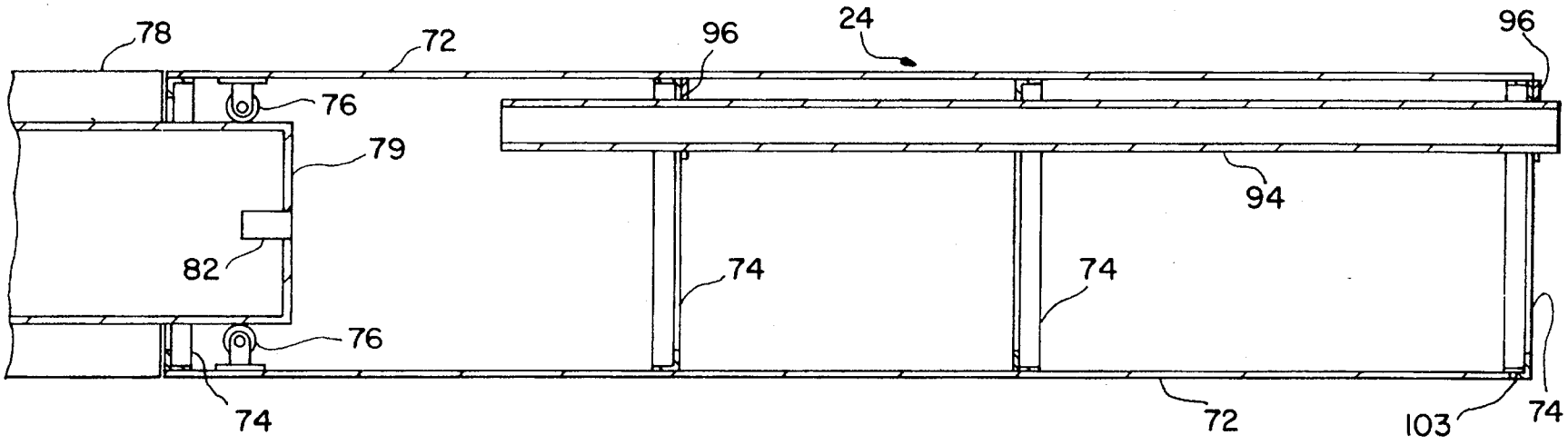
FIG. 5 is a sectional view of a support tube assembly of the embodiment of FIGS. 1–4, which supports thereon a large cylindrical sleeve, shown in position for sleeve transfer.
Figure 6:
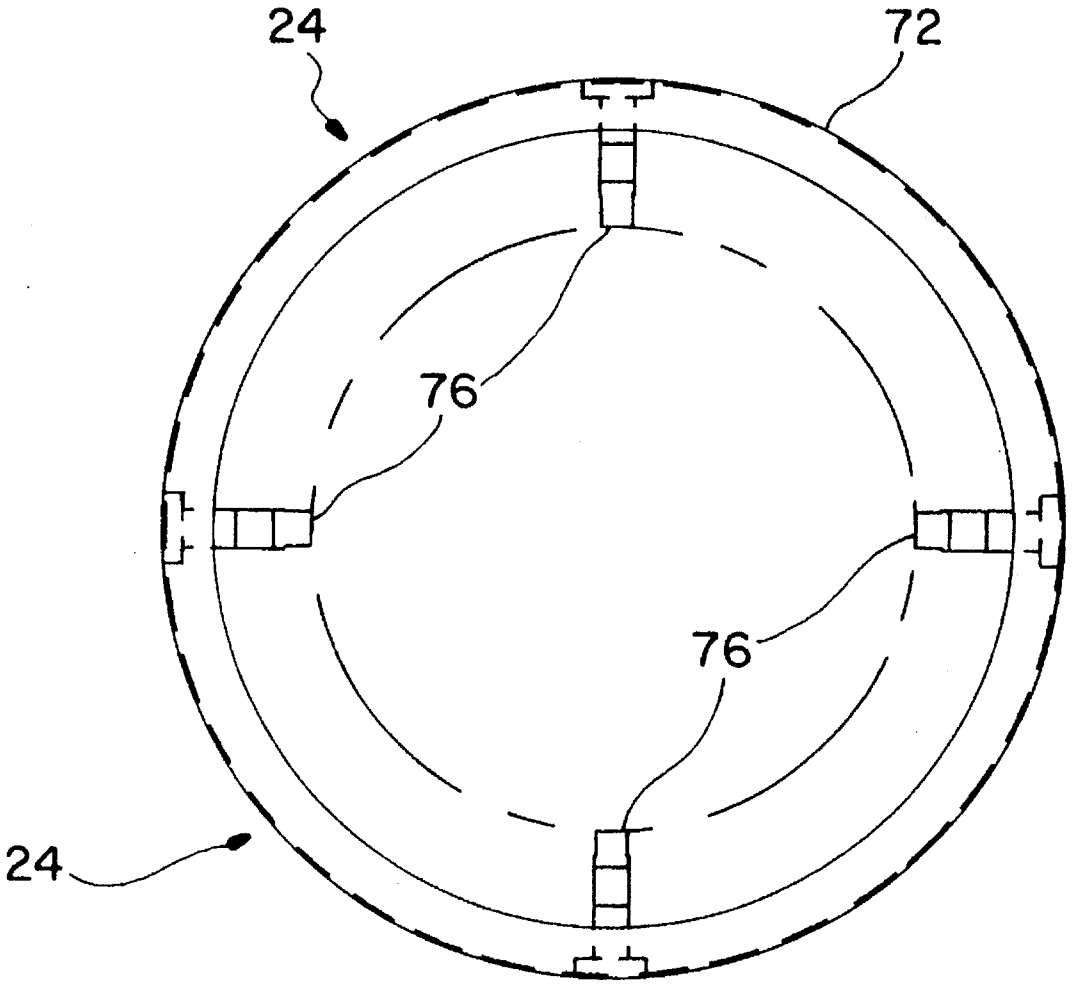
FIGS. 6 and 7 are respectively left front elevational and right rear elevational views of the support tube assembly illustrated in FIG. 5, which supports thereon a large cylindrical sleeve.
Figure 7:
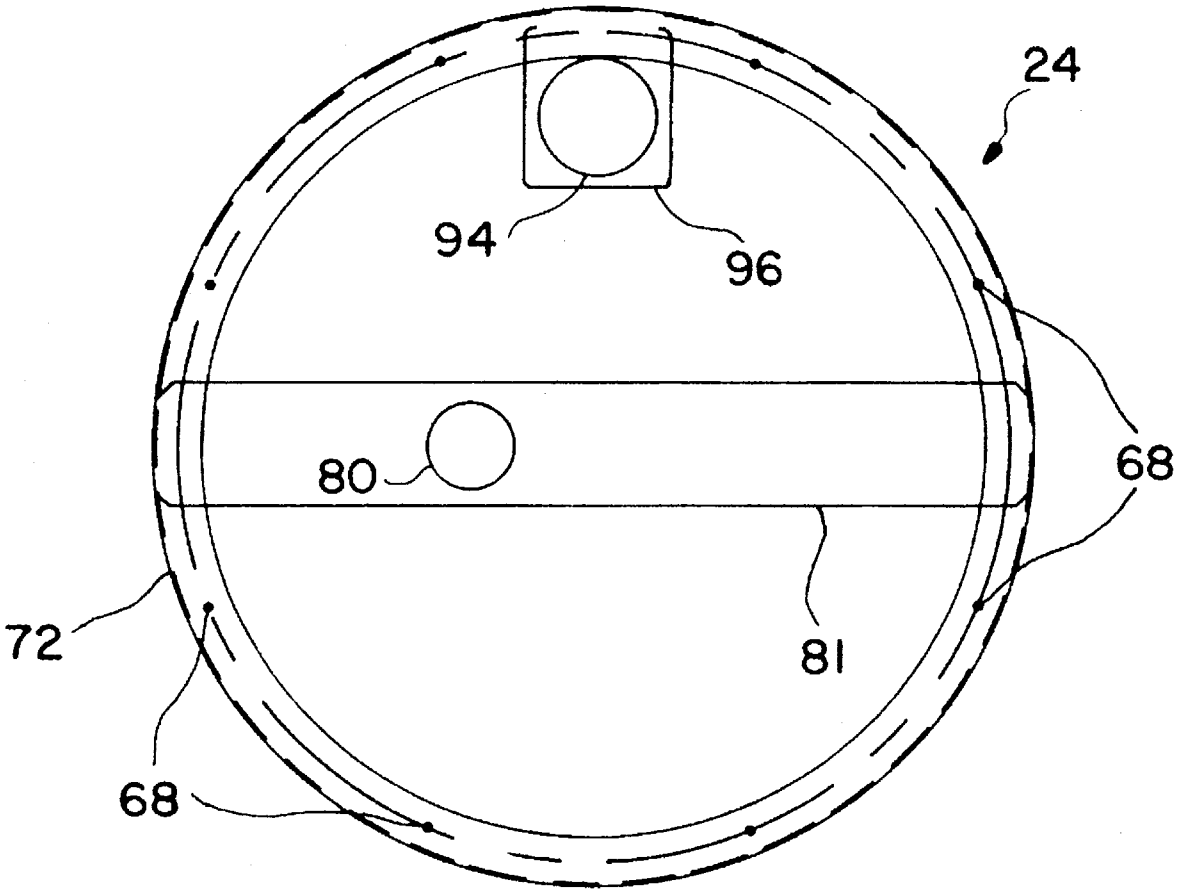

FIGS. 5, 6 and 7 are respectively side elevational, left front elevational, and right rear elevational views of the support tube assembly 24 of the embodiment of FIG. 1–4, which supports thereon the large cylindrical sleeve. The support tube assembly 24 is cantilever mounted at the second or rear end 25 of the shipping container by a bulkhead ring 60 which is mounted to a bulkhead frame 46 adjacent to the second end of the outer housing.

Figure 8:
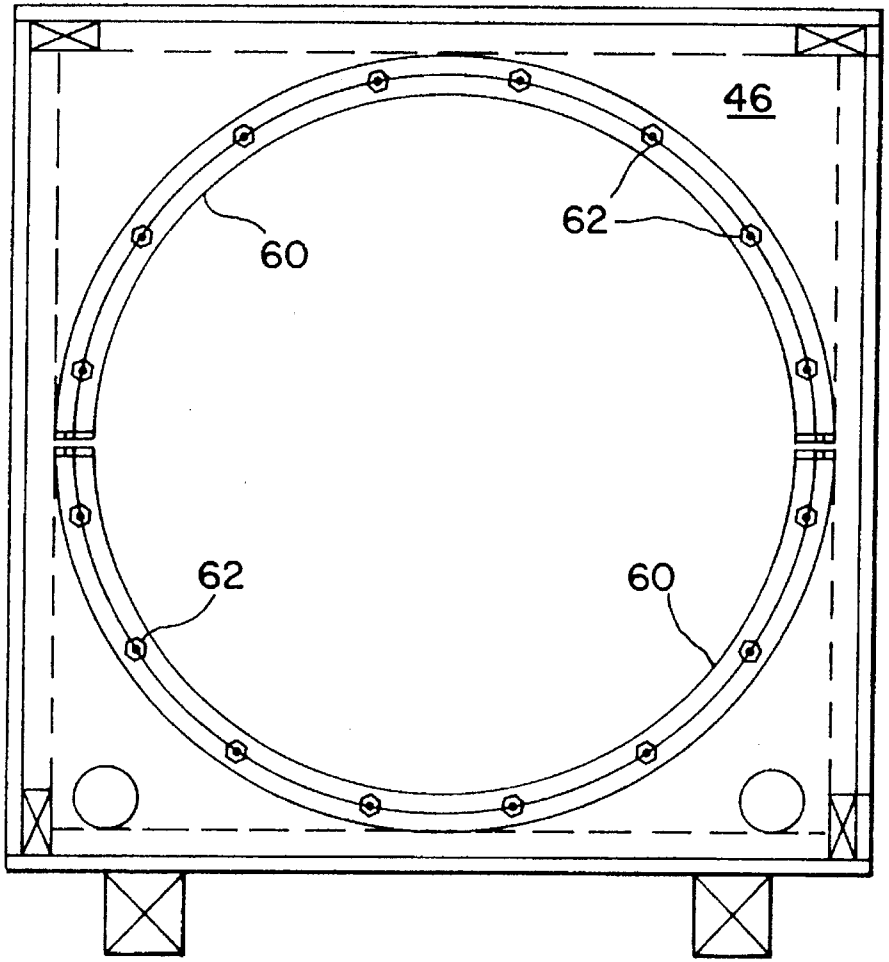
FIGS. 8 and 9 are respectively sectional views taken along arrows 8 and 9 in FIG. 1, and illustrate respectively a bulkhead ring on a bulkhead frame for providing a cantilever mounting for the support tube assembly, and the rear closure wall of the shipping container.
Figure 9:
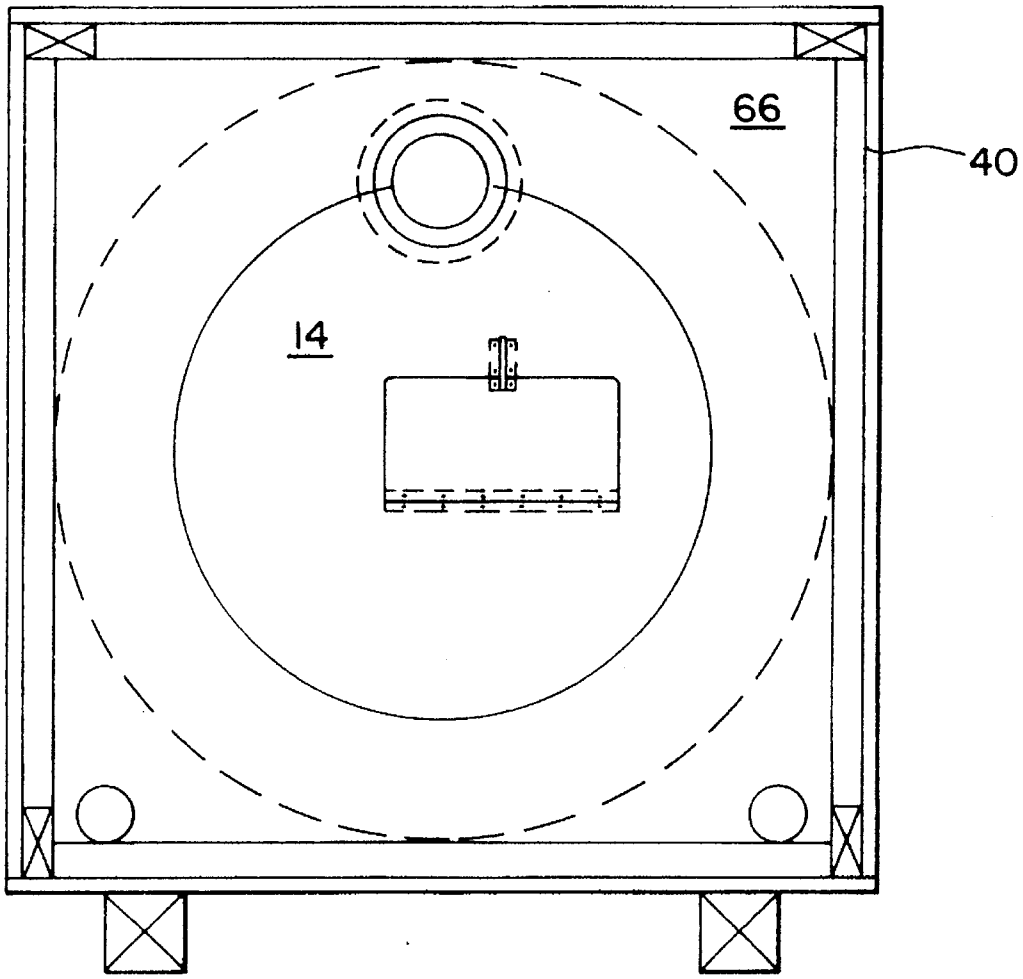
Figure 10:
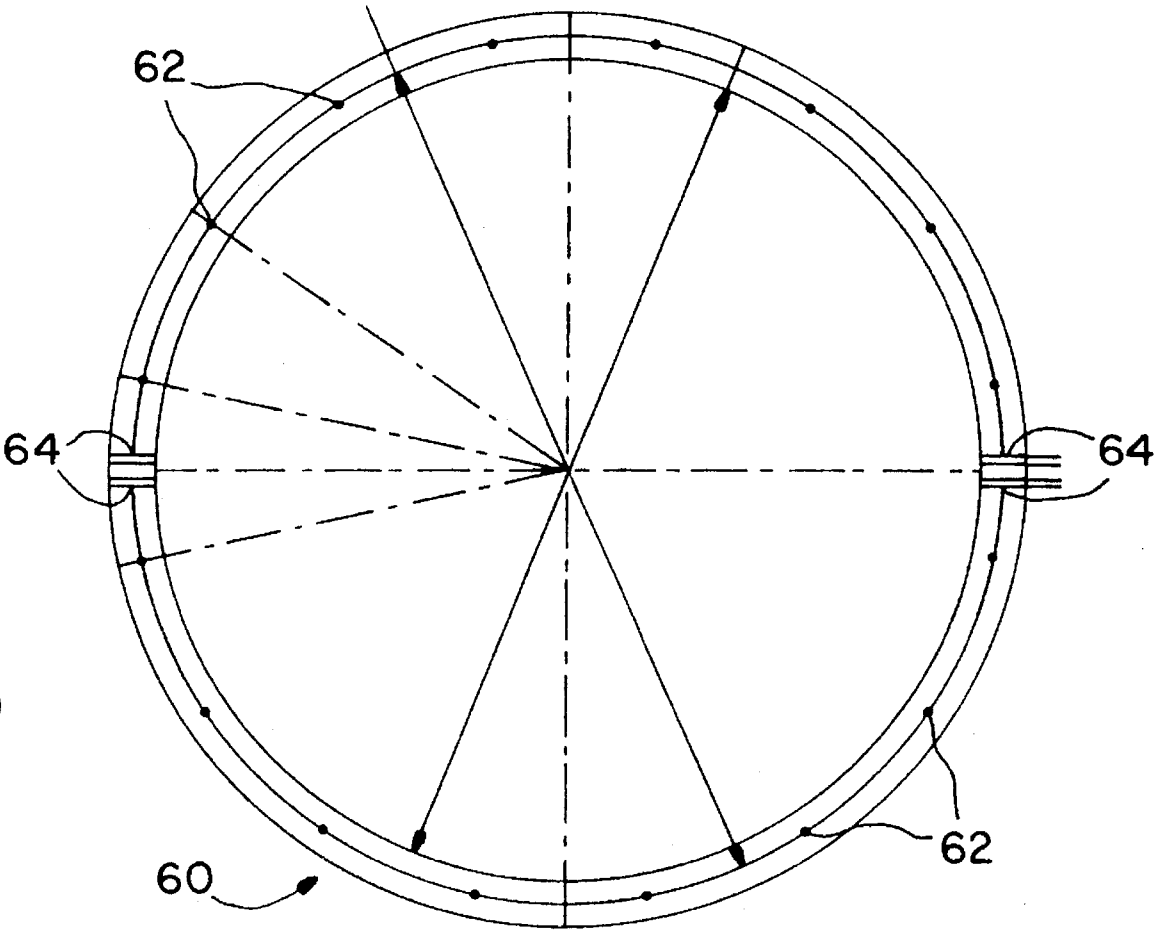
FIGS. 10 and 11 are respectively front elevational and side elevational views of a bulkhead ring for securing and clamping the support tube assembly of FIGS. 5–7.
Figure 11:
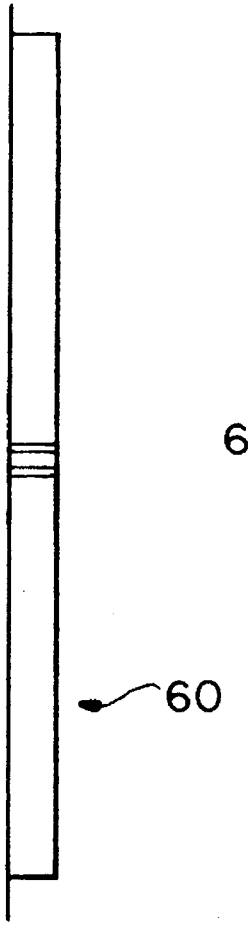

FIG. 8 is a sectional view of the shipping container taken along arrows 8 in FIG. 1, and illustrates the bulkhead member 46 having a large circular opening therein to allow the support sleeve assembly 24 to pass therethrough. A two-piece bulkhead ring 60 is mounted on the plywood bulkhead member 46 by a plurality of fasteners passing through fastener holes 62 in each half of the bulkhead ring. The two-piece bulkhead ring is securely mounted about the support tube assembly by two bolts passing through the holes 64, FIG. 10, at each end of the two-piece bulkhead ring.

The support tube assembly 24 is also directly attached to the rear end closure wall 66 of the shipping container by fasteners passing through holes 68, FIG. 7, in the rearmost support ring 74 of the support tube assembly 24. Accordingly, the support tube assembly 24 projects forwardly from the two cantilever mountings to the front end of the shipping container. The support tube assembly 24 is also directly attached to the lower rear transverse angle bracket 100 by leveling fastener 102 passing through hole 103 which passes through the rearmost rolled steel ring 74 and outer cylindrical surface 72 of support tube assembly 24, rearward transverse frame 40, lower container surace 18 and lower rear transverse angle bracket 100.

An advantage of the cantilever mounting arrangement is that the cylindrical sleeve can be slid onto the freely projecting front end of the support tube assembly using, for instance, suction cup handlers or strap handlers, and slid into position abutting the bulkhead mounted split ring 60 cantilever mounting. The doors 26 of the shipping container are then closed and latched, providing a support for the front end of the support tube assembly, as explained in greater detail hereinbelow.

Figure 13:
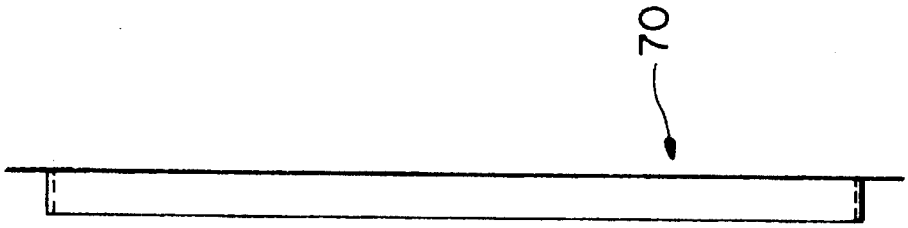
FIGS. 12 and 13 are respectively front elevational and side elevational views of an open end ring which is positioned on the doors of the shipping container, and during shipment, support one end of the support tube assembly of FIGS. 5–7.
Figure 12:
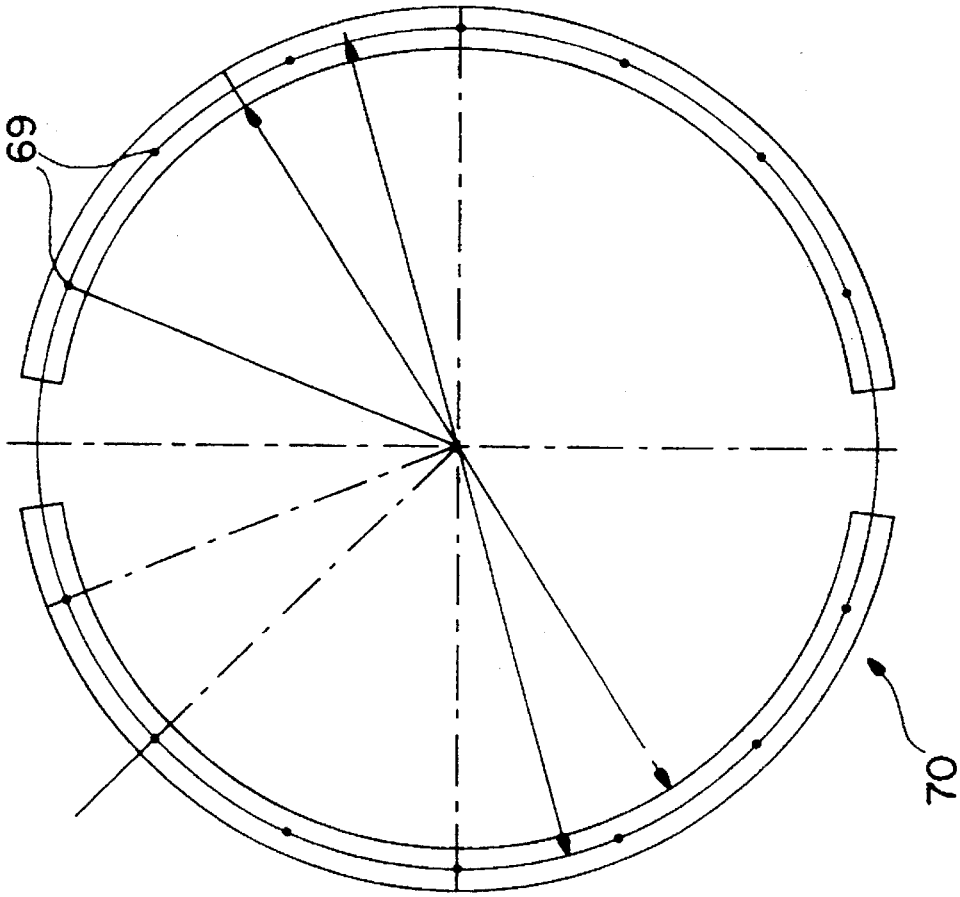
Figure 14:
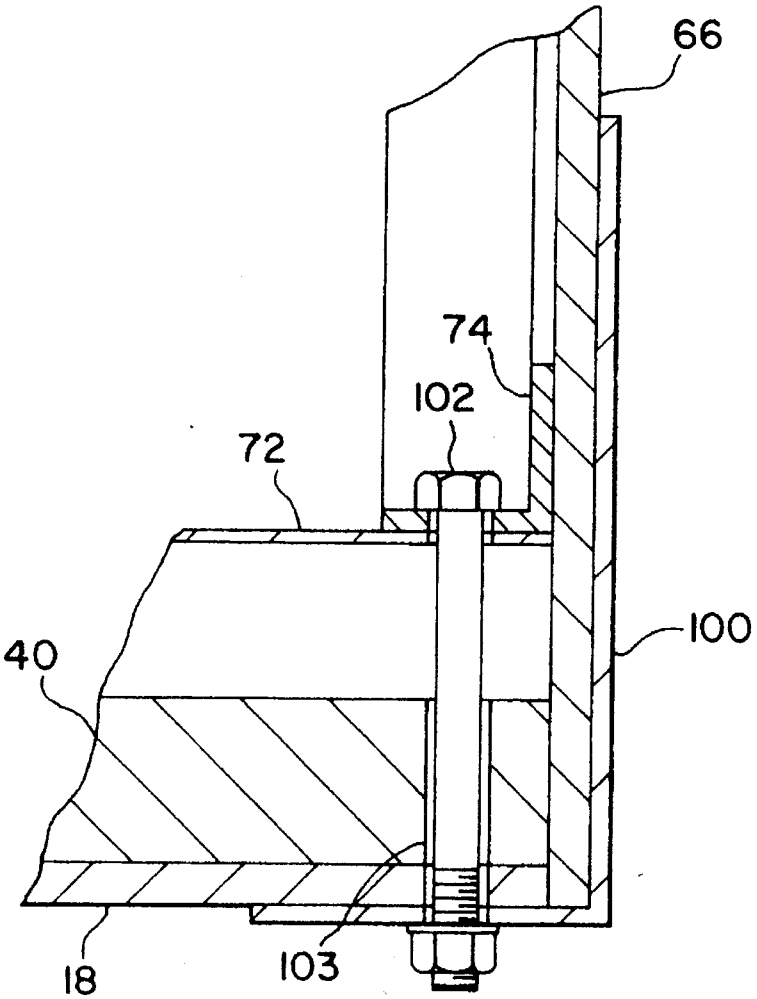
FIG. 14 is an expanded sectional view of the lower right portion of FIG. 1 taken at the centerline of the container along arrow 99 in FIG. 4.

The support tube assembly 24 is also secured 26 at the front end of the shipping container. FIGS. 12 and 13 are respectively front elevational and side elevational views of a split support ring 70 for securing and clamping the support tube assembly. A split support ring 70 is mounted to each end door by fasteners passing through holes 69. When the first and second doors 26 are fully closed, the support rings clamp around and support the projecting end of the support tube assembly 24 opposite to the cantilever mounting. Accordingly, during shipment, the split support ring which is positioned on the doors of the shipping container supports the projecting end of the support tube assembly of FIGS. 5–7.

Referring to FIGS. 5–7, the support tube assembly 24 includes an outer cylindrical surface 72 formed of sheet metal, such as #16 gauge galvanized sheet steel, mounted on a plurality of rolled steel rings 74 positioned internally of and spaced along the length of the support tube. The rolled rings 74 define the diameter and dimensions of the support tube assembly. The front end of the support tube assembly includes a plurality of alignment rollers 76 extending radially inwardly from the inner cylindrical surface of the support tube. The alignment rollers form a first alignment to align a first end of cylindrical sleeve supported within the shipping container with a mandrel 78 in a surfacing machine or a drum 78 of a nonwoven fabric producing machine, which is initially positioned and aligned between the radially inwardly extending alignment rollers. The inwardly projecting alignment rollers define an approximately 24" opening therebetween, and the mandrel of the surfacing machine or the drum of the nonwoven fabric producing machine includes a projecting alignment end 79 having an approximately 24" diameter upon which the alignment rollers slide to provide the alignment.

A second alignment is provided for precisely aligning the second end of a cylindrical sleeve supported within the shipping container with the mandrel or drum. In that regard, a laser target 80, which can be a translucent or transparent cross-hair or other translucent or transparent aiming target, is provided at the second end of the shipping container for a target laser beam produced by a laser 82, shown schematically in FIG. 5, positioned within the mandrel in a surfacing machine or the drum of a nonwoven fabric producing machine to precisely align the second end of a cylindrical sleeve supported within the shipping container therewith. In greater detail, the laser target, which can be a cross-hair or other target, is formed on a translucent or transparent target panel 81 secured to the rear end of the support tube assembly at the rear end of the shipping container. The rear closure surface of the shipping container includes a relatively small flap door 84, mounted by a hinge 86 and secured closed by a clasp 88, which opens to provide a visual inspection of the cross-hair alignment target 80 mounted on the rear wall of the support tube assembly.

The shipping container is provided with a variety of features to enable it to be handled and moved by a variety of freight handling equipment. The shipping container includes forklift truck brackets 90 centrally positioned in a bottom surface of the shipping container, lifting eye brackets 92 extending from a top surface of the shipping container, a carpet pole lifting tube 94 extending longitudinally along the length of the elongated shipping container and having a carpet pole opening in the rear end wall of the shipping container, and a pair of spaced support tubes 101 extending longitudinally along the length of the elongated shipping container from spaced support tube openings near the bottom of the second end wall of the shipping container for a special type of forklift truck attachment device.

As illustrated by FIGS. 4, 5 and 7, the carpet pole lifting tube 94 extends from the rear end of the shipping container forwardly to approximately the front end of the main body of the shipping container, at which the front doors are hinged. The carpet pole lifting tube 94 is a steel tube having a ten foot length, 5" OD, and ⅛" wall thickness. The tube 94 is supported by support hangers 96 on the rear end of the support tube assembly and on the rolled rings 74, and extends for a substantial portion of the length of the support tube assembly.

As illustrated by FIGS. 1 and 4, the special forklift tubes 101 are steel tubes having a ten foot length, and are secured to the shipping container by a plurality of muffler-type clamps 98 which secure the special forklift tubes to the bottom frame of the shipping container.

While several embodiments and variations of the present invention for a shipping container for shipping large cylindrical tubes are described in detail herein, it should be apparent that the disclosure and teachings of the present invention will suggest many alternative designs to those skilled in the art.

What is claimed is:

1. A shipping container for transporting a large cylindrical sleeve, comprising:

a. an elongated outer housing having first and second spaced opposite ends;

b. at least one door positioned at said first end of the outer housing to provide access to the interior of the outer housing to place a cylindrical sleeve in the outer housing or to remove a cylindrical sleeve from the outer housing; and c. a support tube, on which the large cylindrical sleeve is supported in the shipping container, said support tube being mounted within the shipping container by a cantilever mounting at the second end of the outer housing, with the support tube extending interiorly, and substantially to the first end, of the outer housing.

2. A shipping container for transporting a large cylindrical sleeve as claimed in claim 1, wherein the cantilever mounting of the support tube is mounted at the second end of the outer housing by a bulkhead ring which is mounted to a bulkhead adjacent to the second end of the outer housing, and by securing means for securing the support tube to an end cover wall at the second end of the shipping container.

3. A shipping container for transporting a large cylindrical sleeve as claimed in claim 1, wherein said elongated outer housing comprises an elongated rectangular shaped box, and said at least one door comprises first and second doors forming the first end of the elongated rectangular box.

4. A shipping container for transporting a large cylindrical sleeve as claimed in claim 3, wherein each of said first and second doors is hinged respectively to first and second sides of the elongated rectangular box, and each of said first and second doors forms one half of the first end of the elongated rectangular box.

5. A shipping container for transporting a large cylindrical sleeve as claimed in claim 3, wherein each of said first and second doors includes one half of an end closure wall at the first end of the shipping container, and each one half of the end closure wall includes one half of a split support ring which, when the first and second doors are full closed, clamps around and supports an end of the support tube at the first end of the shipping container.

6. A shipping container for transporting a large cylindrical sleeve as claimed in claim 1, including a laser target at the second end of the shipping container for a target laser beam produced by a laser positioned within a mandrel or drum to precisely align a cylindrical sleeve supported within the shipping container with the mandrel or drum.

7. A shipping container for transporting a large cylindrical sleeve as claimed in claim 6, wherein said laser target is formed on a target panel secured at the end of the support tube at the second end of the shipping container.

8. A shipping container for transporting a large cylindrical sleeve as claimed in claim 1, wherein the support tube includes a cylindrical surface, and a first end of said support tube includes a plurality of alignment rollers extending radially inwardly from the cylindrical surface of the support tube, which alignment rollers form a first alignment to align the first end of the support tube and a cylindrical sleeve supported thereby with a mandrel or drum which is initially positioned and aligned between the radially inwardly extending alignment rollers.

9. A shipping container for transporting a large cylindrical sleeve as claimed in claim 1, wherein said shipping container includes forklift truck brackets centrally positioned in a bottom surface of the shipping container, lifting eye brackets extending from a top surface of the shipping container, a carpet pole lifting tube extending longitudinally along the elongated shipping container and having a carpet pole opening in the second end wall of the shipping container, and a pair of spaced support tubes extending longitudinally along the elongated shipping container from spaced support tube openings near the bottom of the second end wall of the shipping container for a special type of forklift truck attachment device.

10. A shipping container for transporting a large cylindrical sleeve as claimed in claim 1, wherein the shipping container is constructed with a plywood exterior housing having front, rear, upper, lower and side walls formed of plywood, and a plurality of bulkhead frames positioned along the length of the elongated shipping container.

11. A shipping container for transporting a large cylindrical sleeve as claimed in claim 1, wherein said support tube includes an outer cylindrical surface formed of sheet metal, and a plurality of rolled rings positioned internally of and spaced along the length of the support tube.

12. A shipping container for transporting a large cylindrical sleeve as claimed in claim 1, wherein said at least one door has a support ring attached thereto such that when the at least one door is closed, the support ring supports the end of the support tube opposite to the cantilever mounting.

13. A shipping container for transporting a large cylindrical sleeve as claimed in claim 12, wherein the support tube is cantilever mounted at the second end of the outer housing by a bulkhead ring which is mounted to a bulkhead frame adjacent to the second end of the outer housing, and by the support tube being secured to an end cover wall at the second end of the shipping container.

14. A shipping container for transporting a large cylindrical sleeve as claimed in claim 1, wherein said elongated outer housing comprises an elongated rectangular shaped box, and said at least one door comprises first and second doors, with each of the first and second doors forming one half of the first end of the elongated rectangular box.

15. A shipping container for transporting a large cylindrical sleeve as claimed in claim 14, wherein each of said first and second doors is hinged respectively to first and second sides of the elongated rectangular box.

16. A shipping container for transporting a large cylindrical sleeve as claimed in claim 15, wherein each of said first and second doors includes one half of an end closure wall at the first end of the shipping container, and each one half of the end closure wall includes one half of a split support ring which, when the first and second doors are fully closed, clamps around and supports an end of the support tube at the first end of the shipping container.

17. A shipping container for transporting a large cylindrical sleeve as claimed in claim 16, including a laser target at the second end of the shipping container for a target laser beam produced by a laser positioned within a mandrel or drum to precisely align a cylindrical sleeve supported within the shipping container with the mandrel or drum.

18. A shipping container for transporting a large cylindrical sleeve as claimed in claim 17, wherein the support tube includes inner and outer cylindrical surfaces, and a first end of said support tube includes a plurality of alignment rollers extending radially inwardly from the inner cylindrical surface of the support tube, which alignment rollers align a cylindrical sleeve supported by the support tube with a mandrel or drum which is initially positioned and aligned between the radially inwardly extending alignment rollers.

19. A shipping container for transporting a large cylindrical sleeve as claimed in claim 18, wherein said support tube includes an outer cylindrical surface formed of sheet metal, and a plurality of rolled rings are positioned internally of and spaced along the length of the support tube.

20. A method of handling a cylindrical backing sleeve comprising, forming a three-dimensional topographical pattern on a blank cylindrical backing sleeve while holding the sleeve on a mandrel, transferring the cylindrical backing sleeve into a shipping container by placing the cylindrical backing sleeve on a support tube which is mounted within the shipping container by a cantilever mounting at one end of the shipping container while aligning the cylindrical backing sleeve with the support tube by using alignment guides on the support tube, transferring the cylindrical backing sleeve from the shipping container to a drum of a fabric forming machine while aligning the cylindrical backing sleeve with the drum by using the alignment guides on the support tube, and utilizing the cylindrical backing sleeve to produce a nonwoven fabric by positioning a layer of fibrous material on the cylindrical backing sleeve and projecting fluid against the fibrous material and cylindrical backing sleeve to form a nonwoven fabric.

21. A method of handling a cylindrical sleeve as claimed in claim 20, further including utilizing the shipping container to transport a blank cylindrical support sleeve to the mandrel and transferring the cylindrical backing sleeve from the shipping container onto the mandrel by using alignment guides on the support tube.

22. A method of handling a cylindrical sleeve as claimed in claim 20, wherein said forming step includes forming a topographical pattern of pyramids and hole openings in the areas at the sides of the pyramids.

23. A method of handling a cylindrical sleeve as claimed in claim 20, wherein said aligning steps include utilizing a plurality of alignment rollers projecting from a first end of the support tube to align the first end of the support tube with the mandrel or drum, and aligning a second end of the support tube by aligning a laser target on the second end of the support tube with a laser beam from a laser mounted on the mandrel or drum.

24. A method of handling a cylindrical sleeve as claimed in claim 20, wherein during the surfacing operation a cylindrical sleeve blank is mounted for rotation on the mandrel, the cylindrical sleeve blank is rotated on the mandrel past a surfacing head operating against the cylindrical sleeve blank, the surfacing head is slowly translated along the length of the cylindrical sleeve blank, and material is selectively removed from the surface of the cylindrical sleeve to form a three-dimensional topographical pattern on the cylindrical sleeve.

25. A method of handling a cylindrical sleeve as claimed in claim 20, wherein the support tube includes a cylindrical surface, and a first end of said support tube includes a plurality of alignment rollers extending radially inwardly from the cylindrical surface of the support tube, and the alignment rollers are used to align the first end of the support tube and a cylindrical sleeve supported thereon with a mandrel or drum, which is initially positioned and aligned between the radially inwardly extending alignment rollers.

26. A method of handling a cylindrical sleeve as claimed in claim 25, wherein a laser target is provided at a second end of the support tube for a target laser beam produced by a laser positioned within a mandrel or drum to precisely align a cylindrical sleeve supported on the support tube with the mandrel or drum.

27. A method of handling a cylindrical sleeve as claimed in claim 20, wherein a laser target is provided at one end of the support tube for a target laser beam produced by a laser positioned within a mandrel or drum to precisely align a cylindrical sleeve supported on the support tube with the mandrel or drum.

28. A method of handling a cylindrical backing sleeve comprising, utilizing a shipping container to transport a blank cylindrical support sleeve to a mandrel by placing the cylindrical backing sleeve on a support tube which is mounted within the shipping container by a cantilever mounting at one end of the shipping container and transferring the cylindrical backing sleeve from the shipping container onto the mandrel by using alignment guides on the shipping container, and forming a three-dimensional topographical pattern onto the blank cylindrical backing sleeve while holding the sleeve on the mandrel.

29. A method of handling a cylindrical backing sleeve as claimed in claim 28, wherein after the forming step, transferring the cylindrical backing sleeve into the shipping container while aligning the cylindrical backing sleeve with the shipping container by using alignment guides on the shipping container.

30. A method of handling a cylindrical sleeve as claimed in claim 28, wherein said forming step includes forming a topographical pattern of pyramids and hole openings in the areas where the sides of the pyramids meet the backing sleeve.

31. A method of handling a cylindrical sleeve as claimed in claim 28, wherein said transferring step includes utilizing a plurality of alignment rollers projecting from a first end of the support tube to align the first end of the support tube with the mandrel, and aligning a second end of the support tube by aligning a laser target on the second end of the support tube with a laser beam from a laser mounted on the mandrel.

32. A method of handling a cylindrical sleeve as claimed in claim 28, wherein during the step of forming a three-dimensional topographical pattern a cylindrical sleeve blank is mounted for rotation on the mandrel, the cylindrical sleeve blank is rotated on the mandrel past a surfacing head operating against the cylindrical sleeve blank, the surfacing head is slowly translated along the length of the cylindrical sleeve blank, and material is selectively removed from the surface of the cylindrical sleeve to form a three-dimensional topographical pattern on the cylindrical sleeve.

33. A method of handling a cylindrical sleeve as claimed in claim 28, wherein the support tube includes a cylindrical surface, and a first end of said support tube includes a plurality of alignment rollers extending radially inwardly from the cylindrical surface of the support tube, and the alignment rollers are used to align the first end of the support tube and a cylindrical sleeve supported thereon with the mandrel, which is initially positioned and aligned between the radially inwardly extending alignment rollers.

34. A method of handling a cylindrical sleeve as claimed in claim 28, wherein a laser target is provided at a second end of the support tube for a target laser beam produced by a laser positioned within the mandrel to precisely align a cylindrical sleeve supported on the support tube with the mandrel.

35. A method of handling a cylindrical sleeve as claimed in claim 28, wherein a laser target is provided at one end of the support tube for a target laser beam produced by a laser positioned within the mandrel to precisely align a cylindrical sleeve supported on the support tube with the mandrel.

36. A method of handling a cylindrical backing sleeve comprising, transporting a cylindrical backing sleeve having a three-dimensional topographical pattern formed thereon into a shipping container by placing the cylindrical backing sleeve on a support tube which is mounted within the shipping container by a cantilever mounting at one end of the shipping container while aligning the cylindrical backing sleeve with the support tube by using alignment guides on the support tube, transferring the cylindrical backing sleeve from the shipping container to a drum of a fabric forming machine while aligning the cylindrical backing sleeve with the drum by using the alignment guides on the support tube, and utilizing the cylindrical backing sleeve to produce a nonwoven fabric by positioning a layer of fibrous material on the cylindrical backing sleeve and projecting fluid against the fibrous material and cylindrical backing sleeve to form a nonwoven fabric.

37. A method of handling a cylindrical sleeve as claimed in claim 36, wherein said cylindrical sleeve has a topographical pattern of pyramids and hole openings in the areas at the sides of the pyramids.

38. A method of handling a cylindrical sleeve as claimed in claim 36, wherein the step of transferring the cylindrical backing sleeve from the shipping container to said drum includes utilizing a plurality of alignment rollers projecting from a first end of the support tube to align the first end of the support tube with the drum, and aligning a second end of the support tube by aligning a laser target on the second end of the support tube with a laser beam from a laser mounted on the drum.

39. A method of handling a cylindrical sleeve as claimed in claim 36, wherein the support tube includes a cylindrical surface, and a first end of said support tube includes a plurality of alignment rollers extending radially inwardly from the cylindrical surface of the support tube, and the alignment rollers are used to align the first end of the support tube and a cylindrical sleeve supported thereon with the drum, which is initially positioned and aligned between the radially inwardly extending alignment rollers.

40. A method of handling a cylindrical sleeve as claimed in claim 36, wherein a laser target is provided at a second end of the support tube for a target laser beam produced by a laser positioned within the drum to precisely align a cylindrical sleeve supported on the support tube with the drum.

41. A method of handling a cylindrical sleeve as claimed in claim 36, wherein a laser target is provided at one end of the support tube for a target laser beam produced by a laser positioned within the drum to precisely align a cylindrical sleeve supported on the support tube with the drum.

* * * * *